US006863562B1

(12) United States Patent
Jensen et al.

(10) Patent No.: US 6,863,562 B1
(45) Date of Patent: Mar. 8, 2005

(54) PIN MOUNTED CIRCUIT BOARD RETAINER

(75) Inventors: Randall Scott Jensen, Rochester, MN (US); Michael T. Peets, Staatsburg, NY (US)

(73) Assignee: International Business Machines Corporation, Armonk, NY (US)

( * ) Notice: Subject to any disclaimer, the term of this patent is extended or adjusted under 35 U.S.C. 154(b) by 5 days.

(21) Appl. No.: 10/645,124

(22) Filed: Aug. 21, 2003

(51) Int. Cl.[7] ..... H01R 13/73
(52) U.S. Cl. ..... 439/571; 174/138 G; 174/164; 361/758; 361/804
(58) Field of Search ..... 439/571; 361/758, 361/770, 804, 790, 801; 174/138 D, 138 E, 138 G, 166 S, 164

(56) References Cited

U.S. PATENT DOCUMENTS 5,008,777 A * 4/1991 Burns ..... 361/804
5,772,471 A * 6/1998 Buck ..... 439/607
5,786,989 A * 7/1998 Kawabe ..... 361/759

* cited by examiner

*Primary Examiner*—Ross Gushi
(74) *Attorney, Agent, or Firm*—Robert W. Lahtinen

(57) ABSTRACT

A connector for attaching a printed circuit board to other apparatus is formed as a separate connector body with a plurality of pins projecting from one end surface that are attached to the printed circuit board by being secured in vias through the board and a threaded opening at the end surface opposite the one end surface from which the pins project. When a bolt is received in the connector threaded opening and drawn tight to secure the printed circuit board to other apparatus, the stresses and material deformation induced by the securing bolt are isolated from the printed circuit board. Further, the attachment of the pins to the printed circuit board rather than the use of screws extending through holes in the circuit board reduces the size of 'keep out' zones that must be avoided by the wiring paths on each wiring surface of the printed circuit board through which mounting holes extend. Fabrication of the connector and assembly of the connector to the printed circuit board are facilitated by providing a pair of parallel side surfaces on the connector body which can be gripped by a tool. The connector can also be used to electrically insulate or provide a current path by the selection of the polymer that forms the connector body portion.

7 Claims, 4 Drawing Sheets

PIN MOUNTED CIRCUIT BOARD RETAINER

FIELD OF THE INVENTION

The present invention relates to connectors and more particularly to a connector structure for securing precision, high density apparatus such as multilayer circuit boards to a supporting structure.

BACKGROUND OF THE INVENTION

Connection techniques currently used for securing printed circuit boards to supporting structures are prone to subject the board to damage. The most frequently used method of printed circuit board mounting is to provide holes in the board through which attachment screws extend. Using this method, the screw head or the washer interposed between the screw head and the board is prone to compress and sometimes penetrate the circuit board causing shorting of wire traces, power planes or both. Further, the screw threads are apt to dig into the walls defining the circuit board holes and can also cause shorting. Finally, the nut or other material adjacent the threaded opening in which the screw is received at the other side of the circuit board can compress into the back side of the circuit board and cause shorting as well. With ever smaller devices, printed circuit wires approaching one micron widths and increasing numbers of layers of circuitry, the above connection practice is progressively more likely to subject the circuit board to damage. The 'keep out' zones, associated with the mounting holes and which must be avoided by printed circuit wires, are not only more significant as printed circuit wire densities become greater, but also further aggravate design constraints if such 'keep out' zones must be increased in size to prevent mechanical damage.

To avoid the adverse effects of mounting printed circuit boards using techniques associated with holes through the board, some boards are fabricated using enlarged 'keep out' zones around the mounting holes that extend radially substantially beyond both the screw head and washer used to attach the board. Although this effectively lessens possible damage by mechanical abrasion, compressive stress and torque induced during attachment, such practice materially increases design constraints as the board real estate available for printed circuit wires is reduced.

SUMMARY OF THE INVENTION

The printed circuit board connector of the present invention comprises a threaded connector encapsulated as a part independent of the board which it will connect to other apparatus. The connector also includes a plurality of pins cantilevered in an axial direction from the connector in the direction opposite from that to which the threaded connector element opens.

The connector pins are received in small though holes in the circuit board and secured by conventional means such as soldering. Since the connector is not embedded in the board, when attachment is made to other supporting structure using a screw or bolt, the stress induced by the application of torque during assembly and the stresses introduced in the assembled connected condition are contained within the connector molded polymer body portion and are not transmitted into the circuit board structure adjacent the location of the connection. The cross sectional area of the pins which secure the connector to the board are only a small fraction of the cross sectional area of the threaded connector insert and do not impose as significant a constraint on the use of the board layer surfaces for current paths.

Use of the disclosed connector serves to isolate the stress and deformation from the circuit board. This relates to both the process of attaching the board to other structure or securing the connector to the board. Likewise, virtually all of the card area is made available for circuitry and conductors without the constraint of accommodating large 'keep out' zones at each of the connector sites. Further, the connector may be used as a conductive path by selecting a conductive polymer for fabricating the connector body or in the alternative may provide electrical isolation between the board and the apparatus to which it is attached by forming the body portion of an electrically insulating polymer material.

DETAILED DESCRIPTION

Figure 1:
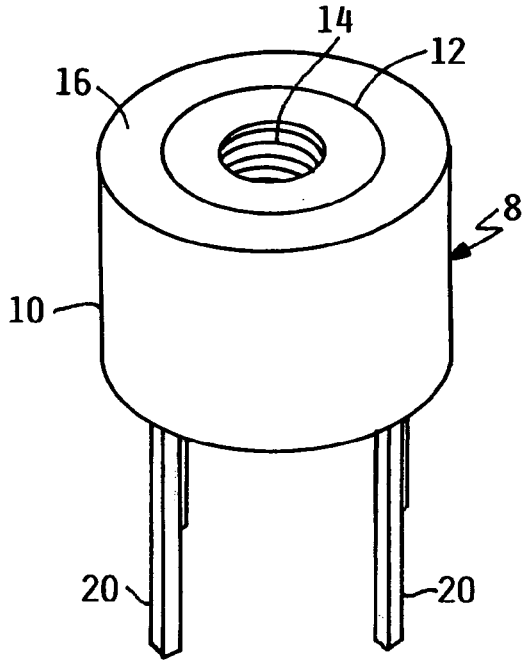
FIG. 1 is an isometric view of the connector of the present invention showing the upper surface with the internally threaded insert.

FIG. 1 is an isometric view illustrating the printed circuit board connector 8 of the present invention. FIG. 1 shows the molded polymer body portion 10 wherein a metal insert 12 is embedded or captured. The metal insert 12 is coaxial with body portion 10 and presents a threaded opening 14 which extends into the body portion from the upper surface 16. Projecting from the body portion lower surface 18 (visible in the bottom view of FIG. 2) are four pins 20 which are also embedded in and captured by the molded polymer body portion 10. These pins 20 are formed of rigid metal, are parallel to one another, and are symmetrically arranged radially outward of the metal insert 12.

The molded polymer body portion 10 may be formed of any polymer that possesses the required characteristics such as strength. An example of such a material that has been used and found satisfactory for the application is poly (ether imide).

Figure 2:
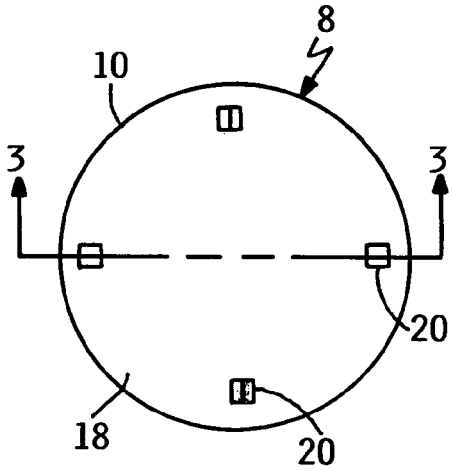
FIG. 2 is a bottom view of the connector of FIG. 1 showing the lower surface from which the cantilevered pins project.
Figure 3:
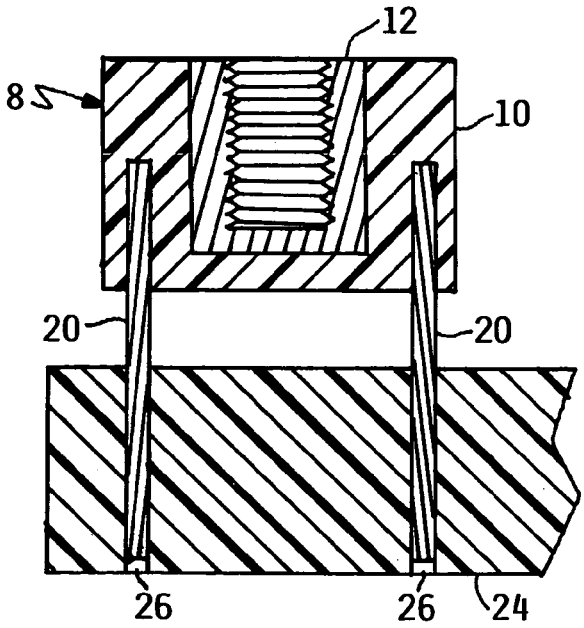
FIG. 3 is a section view of the connector of FIG. 1 taken along line 3—3 of FIG. 2 which shows the connector assembled to a printed circuit board with the cantilevered pins soldered within printed circuit board vias.
Figure 4:
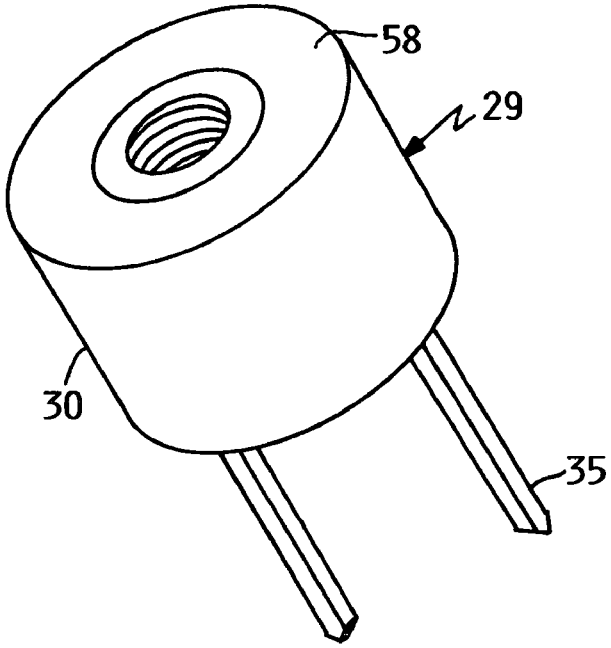
FIG. 4 is an isometric view of a second embodiment of the connector of the present invention.
Figure 5:
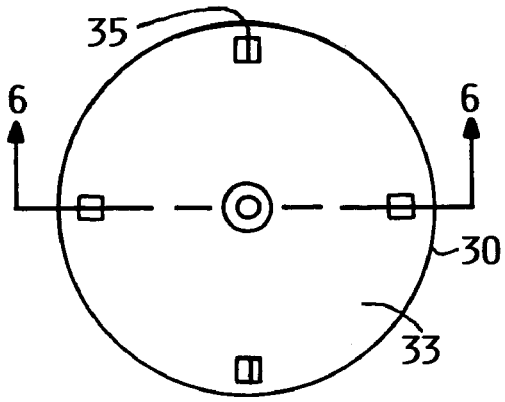
FIG. 5 is a bottom view of the connector of FIG. 4.
Figure 6:
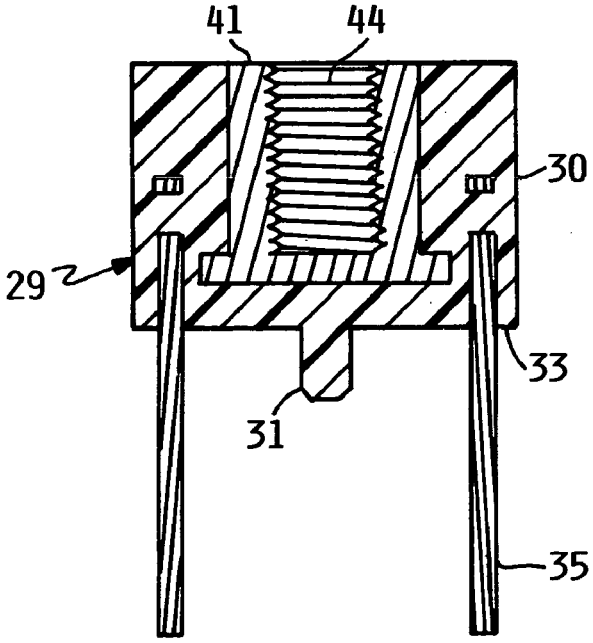
FIG. 6 is a section view of the connector of FIG. 4 taken along line 6—6 of FIG. 5.

FIG. 3 illustrates, in an axial section view through a pair of pins 20 and along line 3—3 of FIG. 2, the connector 8 as assembled to a printed circuit board 24. The printed circuit board has through holes or vias 26 in which are received the terminal ends of the cantilevered pins 20. The pins are secured in the circuit board vias 26 by soldering, but may also be attached by a force fit into a slightly undersized through hole 26 or by using an adhesive.

The circuit board can be installed to other devices or supporting structure by a screw that is received in the connector insert threaded opening 14. The body portion 10 is supported by pins 20 which enable a separation between the body portion 10 and the printed circuit board 24 when assembled as shown in FIG. 3. Using this connector structure, torquing a screw into the threaded opening 14 in the connector insert 12 may induce deformation and displacement of material, but this occurs in the connector body portion which is isolated from the circuit board.

It will be observed that each of the pins 20 has a small cross sectional area. The total cross sectional area of the four pins is a very small fraction of the cross sectional area of a hole extending through the board 24 which would receive an attachment screw such as inserted into the threaded opening 14 to mount the board 24. By comparison with such an opening through the circuit board, which would have to exceed the diameter of the shank of the screw sufficiently to avoid having the wall defining the hole abraded by the aggressive threaded surface of the screw and also tolerate at least modest misalignment, the use of the pins for attachment to the board materially reduces the total area of the 'keep out' zones or area on each layer of the circuit board that must be avoided by the printed circuit wires on the surfaces of the board layers.

Figure 7:
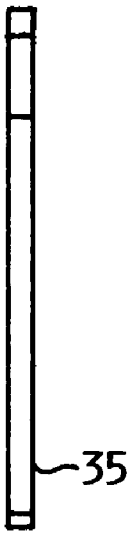

Thus the use of the illustrated retention hardware reduces the design constraints or limitations when laying out the printed circuit wires on the board layer surfaces. The separation created between the connector body and the circuit board which it serves to secure significantly reduces or eliminates mechanical deformation and internal stresses to which the printed circuit board is subjected during both the mounting of the retention hardware on the board and the securing of the board to a supporting structure, FIGS. 4 through 11 illustrate a second embodiment of the connector of the present invention. The connector 29, as shown in the isometric view of FIG. 4, appears to be identical to that of FIG. 1. However, as seen in the section view of FIG. 6 (taken along the line 6—6 of the bottom view of FIG. 5) an axial projection 31 extends from the lower surface 33 of the connector body portion 30. This projection 31 engages a depression in the printed circuit board on which the connector is mounted to provide the desired standoff distance and to correctly align the connector with the board to which it is attached. The connector 29 includes pins 35 which are illustrated in the elevation views of FIGS. 7 and 8. Although the pins 35 may take many forms, in the connector as shown, the pins are stamped from sheet material in a single operation. As seen in FIG. 7 the pins are of uniform thickness. The elevation of FIG. 8 reveals that each pin 35 includes an enlarged upper portion 37 with an aperture 38. Both the pin enlarged portion 37 and the flow of material into the aperture 38 function to capture the pin in the molded polymer body portion 30 to positively position the pin as part of the connector assembly.

The pins 35 could be formed of any material the provides the rigidity and strength necessary to support the connector and maintain the physical support between connector and the printed circuit board on which it is mounted. The pins could be formed of the material of the body portion as is the axial projection 31. However, this would require pins of larger cross section which would defeat one of the major objectives of the invention, to minimize the interference with circuit patterns or the size of 'keep out' zones occasioned by the vias formed in the board to receive the pins and effect the connection of the pins to the board. Accordingly, it is preferred that the pins have the smallest cross sectional size that enables the requisite strength and rigidity. This is best satisfied by a rigid, high strength metal pin that is firmly captured by the material of the body portion 30.

Figure 9:
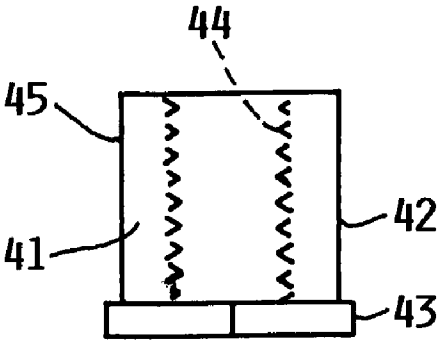
FIG. 9 is a side elevation of the internally threaded axial insert in the molded polymer body portion of the connector of FIG. 4.
Figure 10:
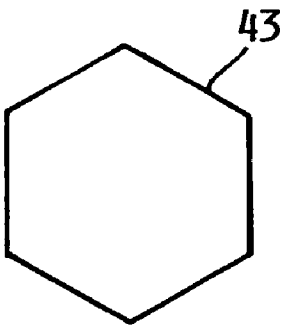
FIG. 10 is a bottom view of the insert of FIG. 9.
Figure 8:
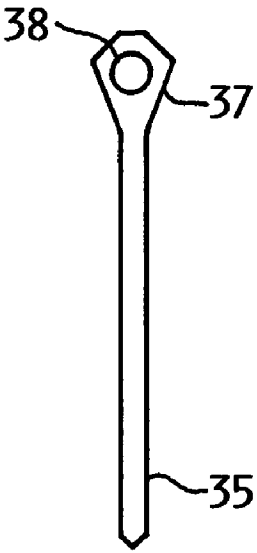
FIGS. 7 and 8 are elevation views of the pins of the connector of FIG. 4 which are inserts captured by the molded polymer body portion of the connector of FIG. 4.

As viewed in FIGS. 9 and 10, the axial insert 41 is formed as a cylinder 42 that terminates in an enlarged end portion 43. The enlarged end portion 43 assures that the insert will be positively captured within the body portion 30. As shown, the insert 41 includes a threaded internal surface 44 for receiving a cooperating connector element such as a bolt. The insert 41 end portion 43 is shown as a hexagonal wall portion that projects axially beyond the cylindrical surface 45 to assure that the insert 41 is captured within the body portion 30 in a manner which resists both axial extraction and rotation.

Figure 11:
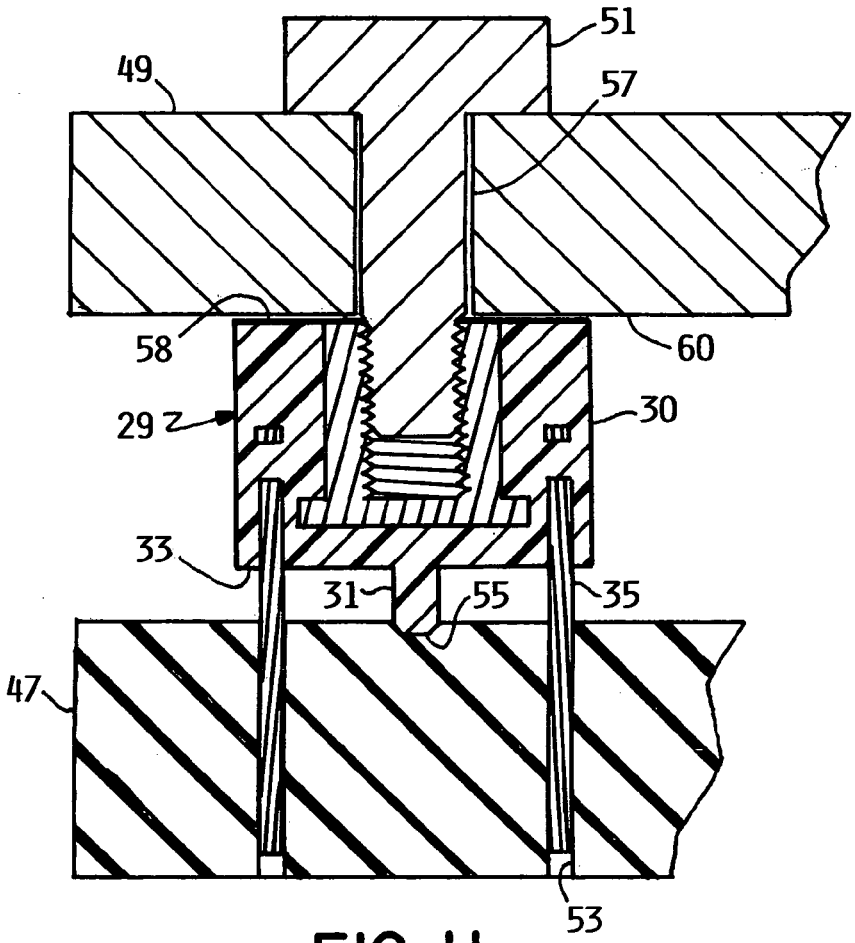
FIG. 11 is an axial section view of the connector of FIG. 4 assembled to a printed circuit board and connected to a frame by a bolt received in the connector threaded insert.

FIG. 11 is a sectional view that shows the connector of FIGS. 4 through 10 supported on a printed circuit board 47 and connected to a frame 49 using a bolt 51. The pins 35 are soldered to the multilayer printed circuit board 47 in through holes or vias 53 with the separation between connector assembly body portion 30 and the printed circuit board determined by the length of the axial projection 31. The alignment of connector assembly 29 with printed circuit board 47 is effected by the engagement of the axial projection 31 with the printed circuit board depression 55. The bolt 51 extends through the frame opening 57 and is received in the threaded cylindrical opening 44 within insert 41 to secure the connector 29 to the frame 49. To prevent the transmission of torque to the connector body as torque is applied to bolt 51 during attachment of the connector to frame 49, a lock washer could be interposed between the connector and the frame or irregular mating surfaces could be formed on the connector body upper surface 58 and the confronting portion of frame surface 60 surrounding the opening 57 through which the bolt 51 is received.

As seen in the assembled section view of FIG. 11, the use of the present connector requires only the four small via openings 53 to extend through the printed circuit board and receive the connector pins 35. This significantly reduces the cross sectional area required for the connection function compared to the size of the opening required to receive the axial insert 41 if it was embedded within the corner off the printed circuit board 47. This materially reduces the interference with the wiring paths at each wiring surface on the multilayer board. In addition, the isolation of the connector body 30 from the printed circuit board 47 reduces or eliminates the effects of induced stress or material distortion as the connecting bolt 51 is secured and drawn tight.

The connector 29 serves to mechanically isolate the connector from the printed circuit board 47. The connector 29 may also serve to electrically isolate the printed circuit board 47 from the frame 49 or may be constructed to provide an electrically conductive path between printed circuit board and frame. Electrical isolation is effected by using an electrically insulating polymer material to mold the body portion 30. To achieve an electrically conductive path between the printed circuit board 47 and frame 49 would only require the use of an electrically conductive polymer material to form the body portion 30.

Figure 12:
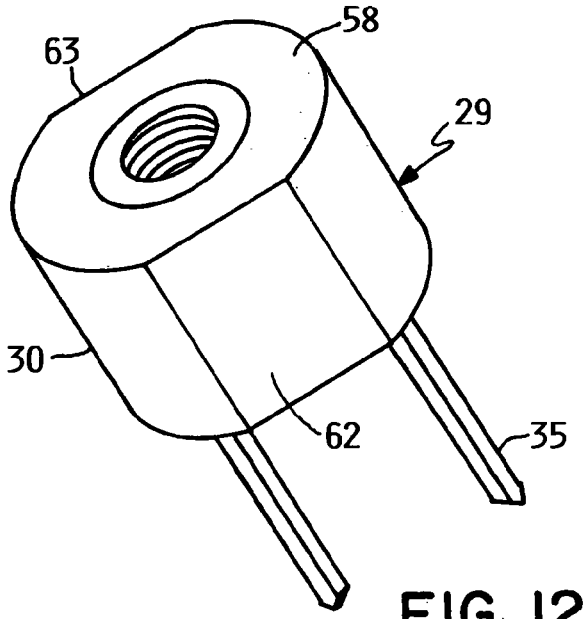
FIG. 12 is an isometric view of a further embodiment of the connector of the present invention wherein the connector body portion is provided with flat side surfaces.

FIG. 12 illustrates a further modification of the structure of the connector 29 wherein the peripheral surface of body portion 30 includes flat surfaces 62 (one of which is visible with the other extending from the surface edge 63). These flat surfaces make it easier for the body portion 30 or the connector assembly 29 to be gripped by a tool and would facilitate the automated assembly of the connector and the automated assembly of the connector to the circuit board.

While the invention has been shown and described with reference to preferred embodiments, it will be understood by those skilled in the art that various changes in form and details may be made therein without departing from the spirit and scope of the invention. By way of example, fewer or more pins may be employed than the four pins shown and described and/or the pin structure could be modified by deforming the pin mid portions or enlarging the pin mid portions to form a shoulder in the connector embodiment of FIGS. 1 through 3 to perform the standoff function of the axial projection of the connector of FIGS. 4 through 11.

What is claimed is:

1. A connector apparatus for securing a printed circuit board to supporting apparatus comprising a body member formed of molded polymer with upper and lower surfaces;

a metal insert captured by said body member which presents an internally threaded opening extending into said body member from said upper surface;

a plurality of at least three rigid, parallel, cantilevered pins captured by said molded polymer and extending from said body member lower surface and disposed radially outward with respect to said threaded opening; and an axial projection, formed as a part of said body member, extending parallel to said pins and having a length which establishes the separation between said connector body member and a board on which said connector apparatus is mounted when said projection engages said board.

2. The connector apparatus of claim 1 wherein said axial projection, formed as part of said body member, and extending parallel to said pins, engages a depression in said board to effect the alignment of said connector with respect to said board.

3. A circuit board including connector structure for attachment to supporting apparatus comprising a circuit board;

a polymer connector body portion with an upper surface facing away from said circuit board and a lower surface which confronts said circuit board;

a metal sleeve insert captured in said polymer body portion presenting an axially extending internally threaded opening extending into said polymer body portion from said upper surface;

a plurality of rigid, parallel, cantilevered pins having end portions encapsulated and retained by said polymer body portion, disposed radially outward with respect to said metal insert and extending to said circuit board;

a like plurality of via openings extending through said circuit board which are aligned with and into which said pin cantilevered ends respectively extend;

means for limiting penetration of said connector pin cantilevered ends into said circuit board via openings, whereby when the connector structure is assembled to said circuit board with said cantilevered pins positioned in said circuit board vias, said body portion is spaced from said circuit board; and solder means securing said pin cantilevered ends respectively in said plurality of circuit board via openings.

4. A connector apparatus for securing a printed circuit board to supporting apparatus comprising a body member with upper and lower surfaces formed as a molded polymer;

an internally threaded surface extending into said body member from said upper surface thereof;

a metal insert captured by said body member molded polymer with said internally threaded formed as an internal threaded surface within said metal insert;

said metal insert including an irregular outer surface which engages said body member polymer to resist extraction of said metal insert from said molded polymer body member and rotation of said metal insert with respect to said molded polymer body member; and a plurality of rigid, parallel, cantilevered pins secured to said body member and extending perpendicular to said lower surface in the direction opposite the direction to which said internally threaded surface opens.

5. The connector apparatus of claim 4 wherein said pins are captured by said molded polymer and extend from said lower surface and said body member molded polymer is an electrically conducting material which provides an electrically conductive path between said pins and said threaded metal insert.

6. The connector apparatus of claim 4 wherein said cantilevered pins are formed of metal with an end portion captured within said molded polymer body member.

7. The connector apparatus of claim 6 wherein said cantilevered pins include irregular surfaces within said molded polymer body member and are positioned radially outward with respect to said metal insert.

* * * * *